US005324044A

United States Patent [19]

Giegerich

[11] Patent Number: 5,324,044

[45] Date of Patent: Jun. 28, 1994

[54] DART ASSEMBLY

[75] Inventor: Paul T. Giegerich, Laverock, Pa.

[73] Assignee: Dart Mart, Inc., Willow Grove, Pa.

[21] Appl. No.: 873,217

[22] Filed: Apr. 24, 1992

[51] Int. Cl.[5] ..... A63B 65/02

[52] U.S. Cl. ..... 273/423

[58] Field of Search ..... 273/423, 420, 416, 422

[56] References Cited

U.S. PATENT DOCUMENTS

| | | | |
|---|---|---|---|
| 3,976,298 | 8/1976 | Hinchman | 273/106.5 |
| 4,006,901 | 2/1977 | Simo | 273/422 |
| 4,842,285 | 7/1989 | Farler | 273/420 |

FOREIGN PATENT DOCUMENTS

| | | | |
|---|---|---|---|
| 516848 | 1/1940 | United Kingdom | 273/423 |
| 531326 | 1/1941 | United Kingdom | 273/423 |
| 2007989 | 5/1979 | United Kingdom | A63B 65/02 |
| 20677116 | 12/1981 | United Kingdom | 273/416 |
| 2097685 | 11/1982 | United Kingdom | 273/416 |

*Primary Examiner*—Paul E. Shapiro

*Attorney, Agent, or Firm*—Finnegan, Henderson, Farabow, Garrett & Dunner

[57] ABSTRACT

A dart flight base has a threaded split spigot which is screwed in to the rear of the barrel of a dart. A flight mounting pin has a head at one end, a ring frictionally fitted around the pin at a location spaced from the head and mounts a flight vane assembly between the head and ring. The flight vane assembly has a plurality of vanes mounted along and extending radially from a central tube. The pin passes through the tube and has a slightly smaller outside diameter than the tube inner diameter which allows the flight vane assembly to spin freely on the pin. The ring can be positioned along the length of the pin to compress the flight tube to a lesser or greater degree between itself and the head to control the degree of spin. The end of the pin opposite the head passes through a bore in the base and spigot and can be positioned to adjust the distance between the head and base. When the base is screwed into the barrel the sides of the spigot compress against the pin to hold it in the adjusted position.

21 Claims, 3 Drawing Sheets

DART ASSEMBLY

BACKGROUND OF THE INVENTION

1. Field of the Invention

The invention relates to a dart subassembly and more particularly to a dart subassembly having an adjustable spin flight.

2. Discussion of the Relevant Art

Darts having fixed flights and spinning flights are well known. Darts having fixed flights are, for example, illustrated in U.K. Patent No. 498,823. Darts having spinning flights are, for example, illustrated in U.S. Pat. Nos. 4,842,285 and 4,958,838.

Darts having spinning flights (i.e., nonfixed flights) have several advantages over their fixed flight counterparts. The most significant of those advantages being that the spinning flight minimizes deflections and allows for a tight grouping of darts. Fixed flight darts already embedded in a dart board, can, when a second dart is thrown and strikes the fixed flight, deflect the second dart in a direction not intended or even out of the play area. Failure to hit the play area results in lower scores. This problem is especially acute when one or more darts are thrown at the same spot on the dartboard, for example, the bull's-eye.

The resulting loss of points or inaccuracy caused by the fixed flight darts was at least one reason for the development of spinning flights. Further, fixed flight darts are prone to breakage because of their construction.

Spinning flights last longer because the flights spin out of the way of incoming darts and reduce the impact on the struck dart which in turn diminishes wear. Spinning flight darts also are more stable in flight.

Existing spinning flights, however, are not without their own problems. For example, the degree of flight spin, i.e., how freely the flight spins during flight, is not controllable — dart players complain that some flights spin either too much or too little. Inconsistent flight spin results in aerodynamic inconsistency while the dart is in flight. The inconsistency is most often caused by variations and inconsistencies in the manufacturing process which result in varying degrees of friction between the flight and pin. Further, current spinning flight darts are susceptible to wear and breakage when assembled/-disassembled.

SUMMARY OF THE INVENTION

One of the objects of the present invention is a dart subassembly having an adjustable spin flight which is easy to construct. Another object of the invention is a dart having an adjustable spin flight which has consistent and reliable spin. Still another object of the invention is a spinning flight dart having a stronger construction and which is more aerodynamic during flight.

Other objects and advantages will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects in accordance with the purpose of the invention, as embodied and broadly described herein, the invention has as its object an adjustable spin flight dart subassembly for connecting to a dart barrel, the subassembly comprising a pin having an enlarged end and an elongated cylindrical portion defining an axis; a flight for spinning about said axis; and means for compressingly engaging a portion of the elongated cylindrical portion of said pin when the engaging means are secured to one end of the dart barrel, said pin being selectively axially moveable to adjust the distance between the enlarged end of said pin and the engaging means.

In addition, the objects and advantages of the invention will be apparent from an adjustable spin flight dart subassembly for connecting to a dart barrel, the subassembly comprising a pin having a first end, an enlarged second end, and an elongated cylindrical portion defining an axis; a flight having a central axial hollow portion for receiving the first end of the pin, the enlarged second end preventing complete passage of the pin through the central axial hollow portion of the flight; and a shaft base comprising a first end, a second end comprising means for compressingly engaging the first end of the pin, and a central axial hollow portion, wherein the first end of the shaft base is adjacent one end of the flight and the central axial hollow portion of the shaft base receives the first end of the pin after passing through the flight, the second end means compressingly engaging the first end of the pin passing through the shaft base when the second end means is secured to one end of the dart barrel, said pin being selectively axially moveable to adjust the distance between said enlarged second end of said pin and said engaging means.

In addition, the object and advantages of the invention will be apparent from an adjustable spin flight dart comprising a pin having a first end, an enlarged second end, and an elongated cylindrical portion defining an axis; a flight having a central axial hollow portion for receiving the first end of the pin, the enlarged second end preventing complete passage of the pin through the central axial hollow portion of the flight; a shaft base comprising a first end, a second end comprising means for compressingly engaging the first end of the pin, and a central axial hollow portion; and a dart barrel having a first end and a second end, wherein the first end of the shaft base is adjacent one end of the flight and the central axial hollow portion of the shaft base receives the first end of the pin after passing through the flight, the second end means compressingly engaging the first end of the pin passing through the shaft base when the second end means is secured to one end of the dart barrel, said pin being selectively axially moveable to adjust the distance between said enlarged second end and said engaging means.

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Reference will now be made in detail to the embodiments of the invention set forth in the accompanying drawings.

Figure 1:
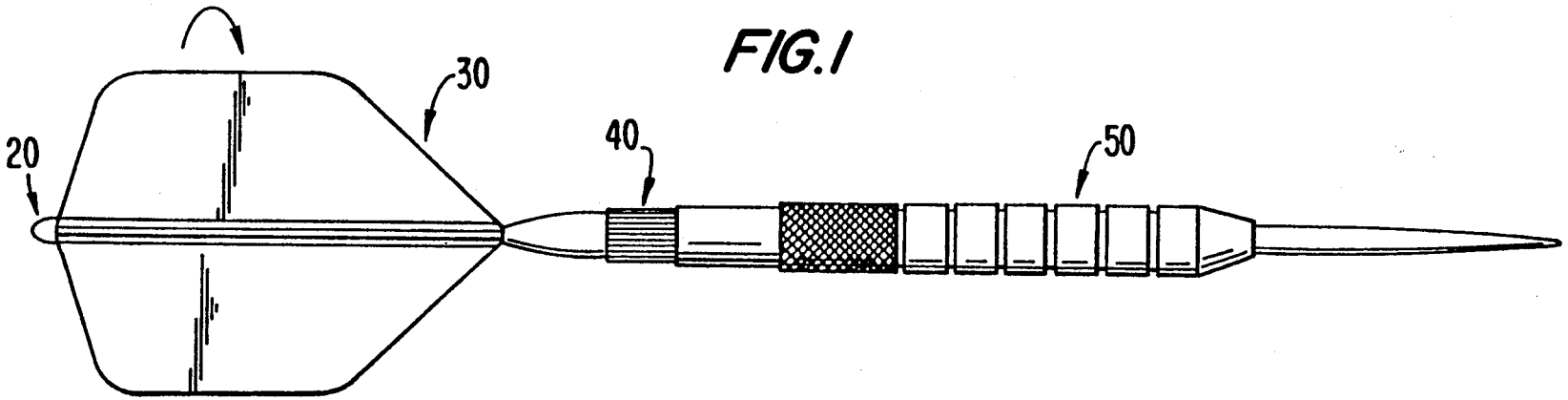
FIG. 1 is a side elevated view of an assembled dart in accordance with the present invention.
Figure 2:
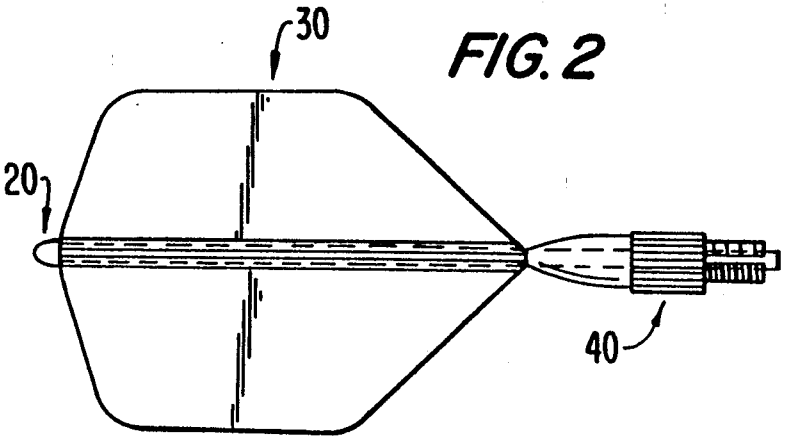
FIG. 2 is a side elevated view of a dart subassembly in accordance with the present invention.

With specific reference to the figures, the invention will now be described. The dart of the present invention as shown in FIG. 1, comprises four primary components, namely a pin 20, a flight 30, a shaft base 40 and a dart barrel 50. The dart subassembly of the present invention, as shown in FIG. 2, comprises the pin 20, the flight 30 and the shaft base 40.

In accordance with the present invention, there is disclosed an adjustable spin flight dart subassembly for connecting to a dart barrel, having a pin having a first end, an enlarged second end and an elongated central portion defining an axis. As embodied herein, the pin 20 shown in FIG. 3 comprises an elongated cylindrical portion 22 having a first end 24 and an enlarged second end 26. As explained in greater detail below with reference to the other figures, the first end 24 of the pin is inserted through a central axial hollow portion of flight 30 and shaft base 40 to form a dart subassembly. The elongated cylindrical portion 22 of the pin 20 is a structural support for the flight and shaft base and constitutes the axis about which the flight rotates, that is, "spins."

The pin 20 is preferably made of metal for strength and durability, more preferably stainless steel. The skilled artisan will recognize that other materials may be used in place of metal if desired. The skilled artisan also will recognize that pin 20 by necessity must be straight and has a constant diameter cylindrical portion 22 to enable the flight to spin and insure the aerodynamic integrity of the assembled dart.

Figure 3:
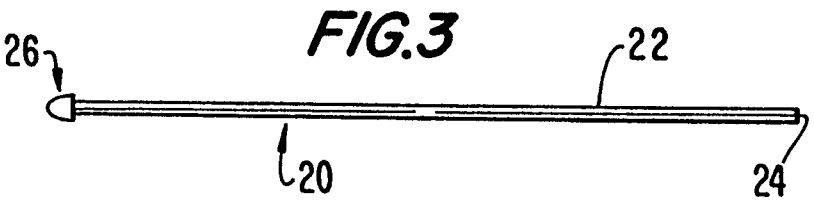
FIG. 3 is a side elevated view of a pin in accordance with the present invention.

The enlarged end 26 of pin 20 prevents the pin from passing completely through the flight and shaft base and insures that the flight and shaft base are maintained in an adjacent relationship. Moreover, as explained further below, the enlarged end portion is used to regulate the degree of flight spin on the pin by adjusting the amount of friction exerted between the enlarged end portion and flight on one end and flight and shaft base on the other end. The enlarged end of the pin, known as a flight protector or point deflector, also is used as a deflection mechanism to prevent other darts which are subsequently thrown from sticking into a dart already in the board ("Robin Hooding"). Although the conical shape of the enlarged end 26 of pin 20 shown in FIG. 3 is preferred to accomplish the above objectives, and is aerodynamically appealing, other designs and shapes obviously may be used.

Figure 5:
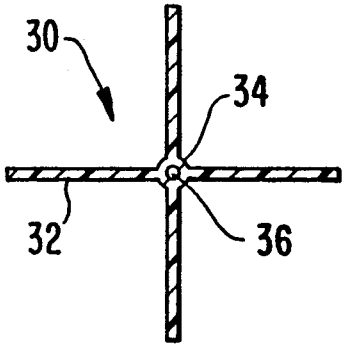
FIG. 5 is a cross section of the flight of FIG. 4 taken along line 5—5.
Figure 4:
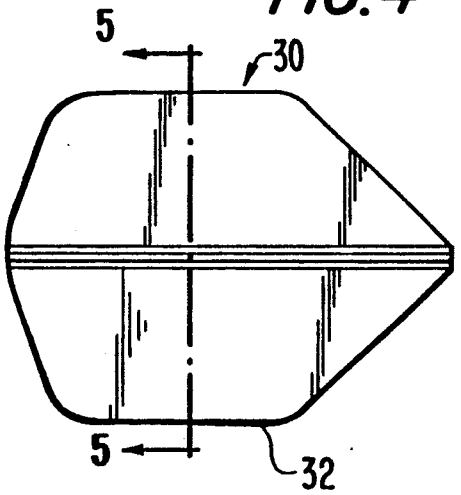
FIG. 4 is a side elevated view of a flight in accordance with the present invention.

In accordance with the present invention, there is disclosed an adjustable spin flight dart subassembly for connecting to a dart barrel, having a flight having a central axial hollow portion for receiving the first end of the pin. As embodied herein, the flight 30 shown in FIGS. 4 and 5 preferably is of conventional design, i.e., having a plurality of veins 32, typically 4. The number and design of veins 32 on the flight may vary according to tastes and other aerodynamic and aesthetic considerations. For purposes of the present invention, the flight preferably is made of a durable molded plastic such as polyethylene. The flight is integrally molded and has a plurality of veins 32 protruding from a bushing tube 34 having a central axial hollow portion 36 running completely through it to receive the first end 24 of pin 20. The skilled artisan will recognize, however, that the flight may be of a different construction and material.

The inner diameter of the hollow portion 36 is uniform and slightly larger than the outer diameter of the elongated cylindrical portion 22 of pin 20 to permit the flight to freely spin on the pin when it passes through the axial hollow portion 36. Further, the central axial hollow portion 36 is straight and located as near to the axial center as required to insure the aerodynamic integrity of an assembled dart in flight and to insure a proper fit between the pin 20 and flight 30. As indicated, the enlarged end portion 26 of the pin prevents it from passing completely through the axial hollow portion 36 of the flight.

In accordance with the present invention, there is disclosed an adjustable spin flight dart subassembly for connecting to a dart barrel, having a shaft base comprising a first end, a second end comprising means for compressingly engaging the first end of the pin, and a central axial hollow portion. As embodied herein, the shaft base 40 shown in FIGS. 6 and 7 comprises a first end 42, a second end comprising means 44 for engaging pin 20 (in a manner to be described in more detail below), and a central axial hollow portion 46 passing completely through shaft base 40 to receive the pin 20 after passing through flight 30. The first end 42 of the shaft base is preferably conical and is positioned adjacent the flight 30. The first end 42 receives the first end 24 of the pin into the central axial hollow portion 46. The pin 20 preferably has a length sufficient to pass completely through the flight 30 and through the shaft base 40 so that the first end 24 of the pin will be approximately flush with or slightly extended beyond the second end (engaging means 44) of the shaft base. It should be recognized, however, that the pin does not have to be either flush with or extend beyond the engaging means.

Figure 7:
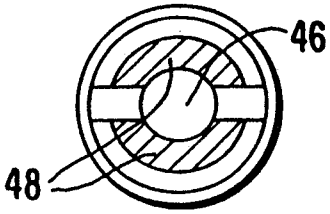
FIG. 7 is an enlarged cross section of the shaft base of FIG. 6 taken along line 7—7.
Figure 6:
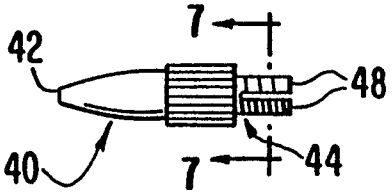
FIG. 6 is a side elevated view of a shaft base in accordance with the present invention.
Figure 9:
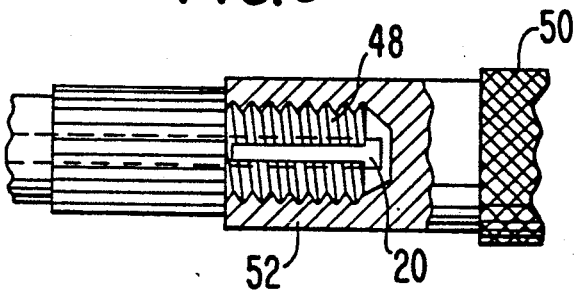
FIG. 9 is an enlarged cutaway of the shaft base and dart barrel of FIG. 1 of the present invention.

In accordance with the present invention, and with reference to FIGS. 6, 7 and 9, the engaging means 44 of the shaft base comprise a plurality of male prongs 48 or similar appendages which, when inserted into the first, receptive female end 52 of a dart barrel 50, will compressingly engage the end portion of pin 20 and secure the pin in place. The outer diameter of the engaging means 44 prior to insertion into the receptive female end 52 is the same as or slightly larger than the inner diameter of the first receptive female end 52 of the dart barrel. Alternatively, the prongs, the female end, or both can have a tapered construction to provide the compressing engagement. Because of the prong construction, the diameter of the engaging means 44 will be reduced when inserted into the receptive female end 52 of the dart barrel and the prongs 48 will compressingly engage the pin 20.

The shaft base 40 may be connected to dart barrel 50 to provide compressing engagement of pin 20 by prongs 48 by a variety of techniques. The preferred technique, and that illustrated in FIGS. 2 and 9, is a shaft base having engaging means 44 which has threaded male prongs 48. The threaded male prongs are threaded into the first, receptive threaded female end 52 of dart barrel 50 and compressingly engage the end portion of pin 20.

Figure 8:
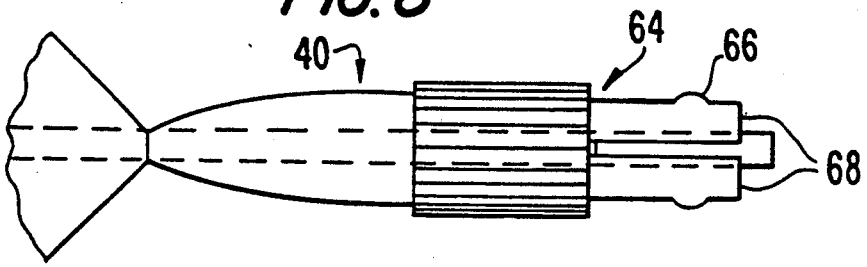
FIG. 8 is a side elevated view of an alternative embodiment of the shaft base in accordance with the present invention.

As shown in the alternative embodiment of FIG. 8, the second end means 64 of the shaft base 40 may be, for example, a snap fit mechanism. For example, for each raised male protrusion 66 on each male prong 68 there would be a corresponding female indentation on the inner surface of the receptive female end of a dart barrel.

Alternatively, the engaging means of the shaft base and first, receptive female end means of the dart barrel may be held together by a frictional force fit, where no threads or protrusions/indentations are required. The second end means of the shaft base would still employ male prongs to compressingly engage the first end of the pin when the male prongs are inserted into the first, receptive female end means of the dart barrel. In accordance with the present invention, the fit between the shaft base and dart barrel, and hence the amount of force exerted by the prongs on the pin, should be sufficient to secure the pin in place and prevent the dart from disassembling while being thrown or handled in a normal manner.

In a preferred embodiment, the pin 20 is partially secured in place in the shaft base by friction created between the cylindrical portion 22 of the pin and the central axial hollow portion 46 of the shaft base. In other words, the inner diameter of the central axial hollow portion 46 is the same as or slightly smaller than the outer diameter of the cylindrical portion 22 of pin 20, to form a tight friction fit relationship. Thus, the pin 20 is retained in the shaft base by a combination of a force fit (friction) between the pin and the central axial hollow portion of the shaft base and the engaging means of the shaft base which compressingly engages the first end portion of the pin when inserted into the dart barrel.

The central axial hollow portion 46 of the shaft base should have a substantially uniform diameter to insure a proper friction fit between it and the pin 20. More importantly, the central axial hollow portion through both the flight and shaft base should be as true as possible to the axial center of the dart to insure its aerodynamic integrity. If the hollow portion is not properly centered it will have adverse effects on the flight of the assembled dart.

In a preferred embodiment of the invention, the entry diameter of the central axial hollow portion in which the first end 24 of the pin is inserted for both the flight and shaft base is made slightly larger to facilitate insertion of the first end of the pin for easy assembly and manufacture of these parts.

The shaft base can be made of well known, conventional, lightweight durable plastic materials such as ABS copolymers or polyethylene. The skilled artisan would recognize the well known and preferred techniques for manufacturing the shaft base.

The dart barrel may be constructed of any conventional materials well known to those skilled in the art. Further, the skilled artisan would recognize that the shape and design of the dart barrel can vary widely and are most often dictated by aesthetic and aerodynamic considerations.

According to the present invention, and with reference to FIGS. 1 and 2, the amount of spin of the flight may be adjusted so that it is a free spin flight (i.e., little or no frictional resistance) or one with reduced or no spin. This adjustment is accomplished by simply pushing the pin 20 further into the shaft base, thereby increasing the friction between the enlarged end portion 26 of the pin and the flight 30. Concomitantly, the friction between the first end 42 of the shaft base and the flight 30 also will be increased. Thus, the pin is selectively axially moveable to vary the distance between the enlarged end of the pin and the engaging means (or any other point of reference on the shaft base).

As the friction asserted against the flight from both the pin and shaft base increases, the rate of spin of the flight decreases. Thus, a dart player can adjust the spin of the flight according to his/her preference by merely adjusting how far the pin 20 is inserted into the shaft base. Adjustment of the pin may or may not require removal of the shaft base from the dart barrel to disengage the compressed prongs from the pin and allow movement thereof.

Figure 10:
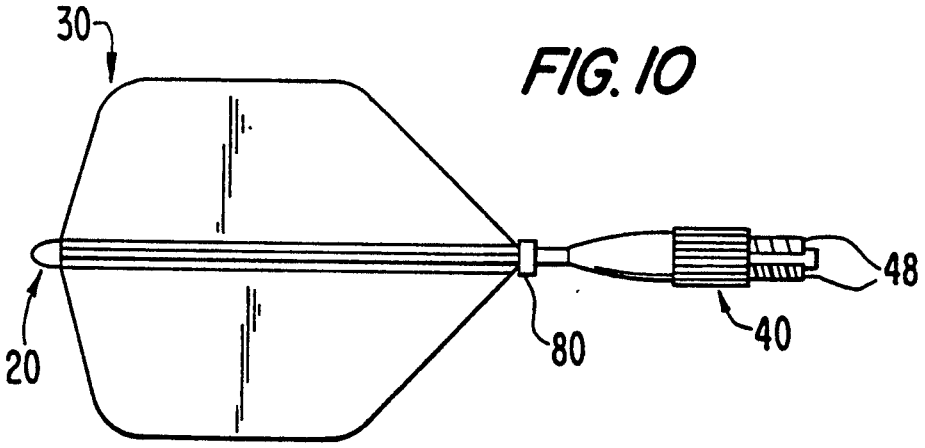
FIG. 10 is a side elevated view of an alternative embodiment of the dart assembly in accordance with the present invention.

In accordance with the present invention, an alternative embodiment of the dart assembly of the present invention is shown in FIG. 10. In all respects, the dart assembly in FIG. 10 is identical to that shown in FIG. 1 except for the presence of ring 80 having a central axial hollow portion. Ring 80 acts in place of the first end 42 of the shaft base 40 to create friction against flight 30. The inner diameter of the central axial hollow portion of the ring 80 is slightly smaller than or the same as the outer diameter of the cylindrical portion 22 of pin 20 so that the ring 80 frictionally engages the pin and stays secured in place. Once in place, the ring 80 is used just like the first end 42 of the shaft base to regulate the amount of spin of the flight by making the necessary adjustments with pin 20. The friction, which regulates the amount of spin of the flight, is created between the enlarged end portion of the pin and flight on one end and the ring and flight on the other end.

It will be apparent to those skilled in the art that various modifications and variations could be made to the dart and dart assembly of the present invention without departing from the scope or spirit of the invention.

What is claimed is:

1. An adjustable spin flight dart subassembly for connecting to a dart barrel, the subassembly comprising:

(i) a pin having a first end, an enlarged second end, and an elongated cylindrical portion defining an axis and having an outer diameter;

(ii) a molded single piece flight having a plurality of vanes and a central elongated tubular portion having an axial hollow portion formed therein for receiving the first end of said pin, said axial hollow portion having an inner diameter which is slightly larger than the outer diameter of said pin to permit said flight to spin about the axis, and wherein said enlarged second end of said pin prevents complete passage of said pin through the axial hollow portion of said flight;

(iii) a shaft base comprising a first end, a second end comprising means for compressingly engaging the first end of said pin, and a central axial hollow portion; and (iv) a ring having a central axial hollow portion with an inner diameter the same as or less than the outer diameter of said pin and positioned between said flight and said shaft base, wherein the respective central axial hollow portions of said ring and shaft base receive the first end of said pin after passing through said flight, said second end means of said shaft base compressingly engaging said first end of said pin passing through said shaft base when the second end means is secured to one end of the dart barrel, said pin being selectively axially movable to adjust the distance between said enlarged second end of said pin and said ring and thereby regulate the amount of flight spin between freely spinning and fixed.

2. The dart subassembly of claim 1, wherein the engaging means of said shaft base comprises threaded male prong means for threadably engaging a threaded receptive female end of the dart barrel.

3. The dart subassembly of claim 1, wherein the engaging means of said shaft base comprises male prong means having at least one male protrusion for engagement with a corresponding female indentation in a receptive female end of the dart barrel.

4. The dart subassembly of claim 1, wherein the engaging means of said shaft base comprises male prong means for a friction fit with a receptive female end of the dart barrel.

5. The dart subassembly of claim 1, wherein the central axial hollow portion of said shaft base has an inner diameter which is the same as or less than an outer diameter of the enlongated cylindrical portion of said pin to form a friction fit between the pin and central axial hollow portion.

6. The dart subassembly of claim 1, wherein said enlarged second end of the pin is shaped to deflect incoming darts.

7. The dart subassembly of claim 6, wherein the shape is conical.

8. An adjustable spin flight dart comprising:

(i) a pin having a first end, an enlarged second end, and an elongated cylindrical portion defining an axis and having an outer diameter;

(ii) a molded single piece flight having a plurality of vanes and a central elongated tubular portion having an axial hollow portion formed therein for receiving the first end of said pin, said axial hollow portion having an inner diameter which is slightly larger than the outer diameter of said pin to permit said flight to spin about the axis, and wherein said enlarged second end of said pin prevents complete passage of the pin through the axial hollow portion of said flight;

(iii) a shaft base comprising a first end, a second end comprising means for compressingly engaging the first end of said pin, and a central axial hollow portion;

(iv) a ring having a central axial hollow portion with an inner diameter the same as or less than the outer diameter of said pin and positioned between said flight and said shaft base; and (v) a dart barrel having a first end and a second end, wherein the respective central axial hollow portion of said ring and shaft base receive the first end of said pin after passing through said flight, said second end means of said shaft base compressingly engaging said first end of said pin passing through said shaft base when the second end means is secured to one end of the dart barrel, said pin being selectively axially movable to adjust the distance between said enlarged second end of said pin and said ring and thereby regulate the amount of flight spin between freely spinning and fixed.

9. The dart of claim 8, wherein the engaging means of said shaft base comprises threaded male prong means for threadably engaging a threaded receptive female end of the dart barrel.

10. The dart of claim 8, wherein the engaging means of said shaft base comprises male prong means having at least one male protrusion for engagement with a corresponding female indentation in a receptive female end of the dart barrel.

11. The dart of claim 8, wherein the engaging means of said shaft base comprises male prong means for a friction fit with a receptive female end of the dart barrel.

12. The dart of claim 8, wherein the central axial hollow portion of said shaft base has an inner diameter which is the same as or less than an outer diameter of the elongated cylindrical portion of said pin to form a friction fit between the pin and central axial hollow portion.

13. The dart of claim 8, wherein said enlarged second end of the pin is shaped to deflect incoming darts.

14. The dart of claim 13, wherein the shape in conical.

15. An adjustable spin flight dart subassembly for connecting to a dart barrel, the subassembly comprising:

(i) a pin having an enlarged end and an elongated cylindrical portion defining an axis and having an outer diameter;

(ii) a molded single piece flight having a plurality of vanes and a central elongated tubular portion having an axial hollow portion formed therein for receiving said pin, said axial hollow portion having an inner diameter which is slightly larger than the outer diameter of said pin to permit said flight to spin about the axis, and wherein said enlarged second end of said pin prevents complete passage of said pin through the axial hollow portion of said flight;

(iii) means for compressingly engaging a portion of the elongated cylindrical portion of said pin when said engaging means are secured to one end of the dart barrel; and (iv) a ring having a central axial hollow portion with an inner diameter the same as or less than the outer diameter of said pin and positioned between said flight and said engaging means, said pin passing through said ring, wherein said pin is selectively axially movable to adjust the distance between said enlarged end of said pin and said ring and thereby regulate the amount of flight spin between freely spinning and fixed.

16. The dart subassembly of claim 15, wherein the engaging means comprises threaded male prong means for threadably engaging a threaded receptive female end of the dart barrel.

17. The dart subassembly of claim 15, wherein the engaging means comprises male prong means having at least one male protrusion for engagement with a corresponding female indentation in a receptive female end of the dart barrel.

18. The dart subassembly of claim 15, wherein the engaging means comprises male prong means for a friction fit with a receptive female end of the dart barrel.

19. The dart subassembly of claim 15, wherein the engaging means further comprises a shaft base having a central axial hollow portion with an inner diameter which is the same as or less than an outer diameter of the elongated cylindrical portion of said pin to form a friction fit between the pin and central axial hollow portion.

20. The dart subassembly of claim 15, wherein said enlarged end of the pin is shaped to deflect incoming darts.

21. The dart subassembly of claim 20, wherein the shape is conical.

* * * * *